US006152380A

United States Patent [19]

Dupre

[11] Patent Number: 6,152,380

[45] Date of Patent: Nov. 28, 2000

[54] SNOW MAKING TOWER

[76] Inventor: Herman K. Dupre, c/o Seven Springs, Champion, Pa. 15622

[21] Appl. No.: 09/494,446

[22] Filed: Jan. 31, 2000

[51] Int. Cl.[7] ..... F25C 3/04

[52] U.S. Cl. ..... 239/14.2; 239/423

[58] Field of Search ..... 239/14.1, 14.2, 239/2.1, 2.2, 418, 421, 423, 296

[56] References Cited

U.S. PATENT DOCUMENTS

| | | | |
|---|---|---|---|
| 3,716,190 | 2/1973 | Lindlof | 239/14.2 |
| 4,465,230 | 8/1984 | Ash | 239/14.2 |
| 5,810,251 | 9/1998 | McKinney | 239/14.2 |
| 5,823,427 | 10/1998 | Dupre et al. | 239/14.2 |
| 5,836,513 | 11/1998 | Smith et al. | 239/14.2 |
| 5,884,841 | 3/1999 | Ratnik et al. | 239/14.2 |

*Primary Examiner*—James Hook
*Assistant Examiner*—Christopher S. Kim
*Attorney, Agent, or Firm*—Carothers & Carothers

[57] ABSTRACT

A snow making tower which includes an elongated tower conduit combination having an elongated air conduit extending within an elongated first water conduit. Air and first water discharge nozzles are respectively provided adjacent the upper end of these conduits for producing a plume of atomized water for external interacting air and water discharged under pressure from these air and first water discharge nozzles to produce snow in subfreezing ambient conditions. Multiple second water discharge nozzles are also provided adjacent the upper end of the tower and positioned for directing at least a portion of their water spray discharge for ultimate interaction with the plume. The air and first water discharge nozzles are detachably mounted in respective nozzle housings at the top of the tower structure. These nozzle housings are independently connected to the tower structure at its upper end with respective air and water metal connecting tubes. The air and first water discharge nozzles are incorporated into a single nozzle head with a central water discharge orifice and two air discharge orifices positioned on opposite sides of the water discharge orifice.

8 Claims, 5 Drawing Sheets

SNOW MAKING TOWER

BACKGROUND OF THE INVENTION

This invention relates generally to the art of fluid sprinkling and more particularly to the manufacture of snow. Specifically, the present invention relates to snow making towers for manufacturing snow on ski slopes and the like.

The present invention pertains to improvements in snow making towers of the type disclosed in U.S. Pat. No. 5,004,151, issued Apr. 2, 1991, and U.S. Pat. No. 5,823,427, issued Oct. 20, 1998.

These former inventions for artificially producing snow consist of method and apparatus for making snow through the use of snow towers wherein water is supplied under pressure to a point of discharge well above ground level and adjacent the top end of the tower where it is discharged through a first water nozzle into ambient freezing atmosphere in the form of spray. The spray is preferably a high velocity spray of discrete water particles, sometimes referred to as a fine water spray.

Air is also supplied independently under pressure to a second point of discharge at the top of the snow tower and there discharged through an orifice to form a jet of air which is directed to interact with the aforementioned water spray thereby forming a plume of atomized or nucleated water. This atomized water forms ice seed crystals in a freezing atmosphere, and through the dwell time of the long fall from the top of the tower to the ground, forms snow.

These afore-referenced patents also increase the efficiency of the water tower in cold or subfreezing ambient conditions by adding additional water discharge nozzles near the top of the tower which discharge additional water spray to also eventually interact with the plume already created.

While these prior art systems are extremely efficient and effective, it is always desirable to make larger quantities of excellent quality snow at higher ambient temperatures with greater efficiency and less use of compressed air, which is the most expensive component required in the system.

It is therefore a principal object of the present invention to provide apparatus for making snow at even higher marginal subfreezing temperatures, and to do so at excellent efficiency rates at a low cost and to do so with the use of less compressed air.

SUMMARY OF THE INVENTION

The snow making tower of the present invention is comprised of an elongated tower conduit combination, including an elongated air conduit extending within an elongated first water conduit. This conduit combination is further provided with a ground support mount or system for mounting the tower.

Air and first water discharge nozzles are respectively provided adjacent the upper ends of these conduits for producing a plume of atomized water from external interacting air and water discharged under pressure from these air and first water discharge nozzles to produce snow in subfreezing ambient conditions. At least one second water discharge nozzle is also provided adjacent the upper end of this elongated first water conduit and positioned for directing at least a portion of water spray discharged therefrom for interaction with the afore-described plume. Couplings are also provided at the lower end of the air and first water conduits for connecting air and water under pressure respectively thereto.

In the embodiment of the present invention, the air and first water discharge nozzles are detachably mounted in a nozzle housing which is supported externally of the air and first water conduits at the top of the tower and this nozzle housing is in turn connected respectively to upper ends of the air conduit and the first water conduit through or with separate air and water connecting tubes. Exposed portions of the air connecting tube are minimal in length in order to prevent freezing of moisture which may be present in air passing through the air connecting tube. These connecting tubes are also preferably constructed of metal, such as copper or aluminum, to provide maximum heat conductivity.

The air and first water discharge nozzles are preferably incorporated into a single nozzle head with a central water discharge orifice and two air discharge orifice positioned on opposite sides of the water discharge orifice and directed to discharge air under pressure into water discharged under pressure from the water discharge orifice. A third water nozzle may also be positioned on the afore-described first water conduit for directing additional water spray into the plume. This third water nozzle may be independently connected to a supply of water under pressure through a third conduit which is valved for selectively connecting the lower end of this third water conduit to the supply of water under pressure.

The elongated tower conduit combination extends upwardly at an angle from vertical and an upper portion of the tower conduit combination, which supports the first and second water nozzles, extends upwardly from a bend in the conduit combination in a more vertical manner and the afore-described third water nozzle is positioned at this bend. This configuration permits easy manufacture of the tower and easy positioning of all the nozzles for proper interaction of the fluids ejected therefrom.

The nozzle housing for each air and first water nozzle also preferably includes a removable clean-out plug positioned opposite the nozzle heads whereby internal access is provided to the nozzle head when the plug is removed for permitting cleaning access to the water discharge orifice.

BRIEF DESCRIPTION OF THE DRAWINGS

Other objects and advantages appear hereinafter in the following description and claims. The accompanying drawings show, for the purpose of exemplification, without limiting the invention or appended claims, certain practical embodiments illustrating the principals of this invention wherein:

DETAILED DESCRIPTION OF A PREFERRED EMBODIMENT

Figure 1:
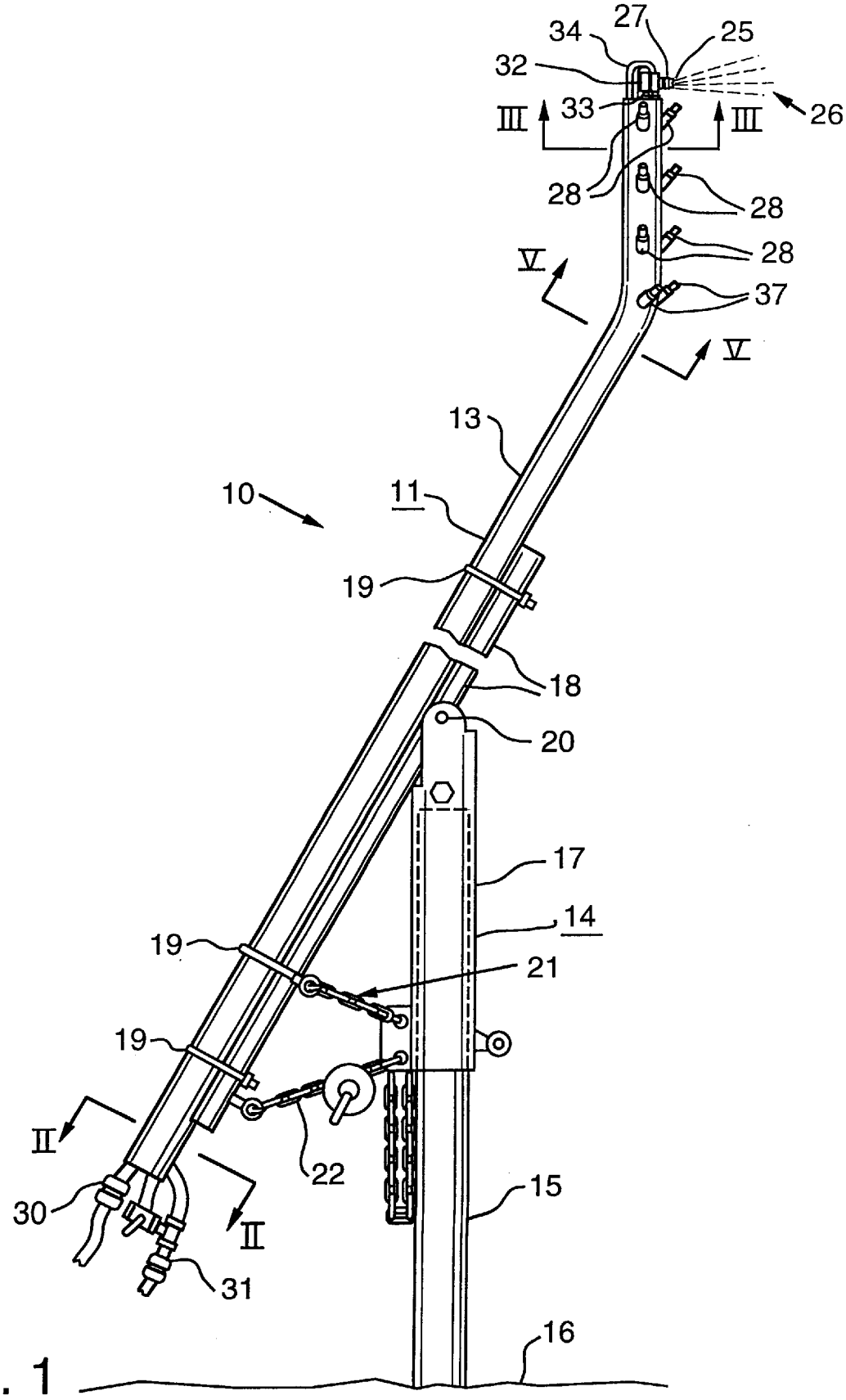
FIG. 1 is a view in side elevation of an embodiment of the snow making tower of the present invention with mid portions removed.
Figure 2:
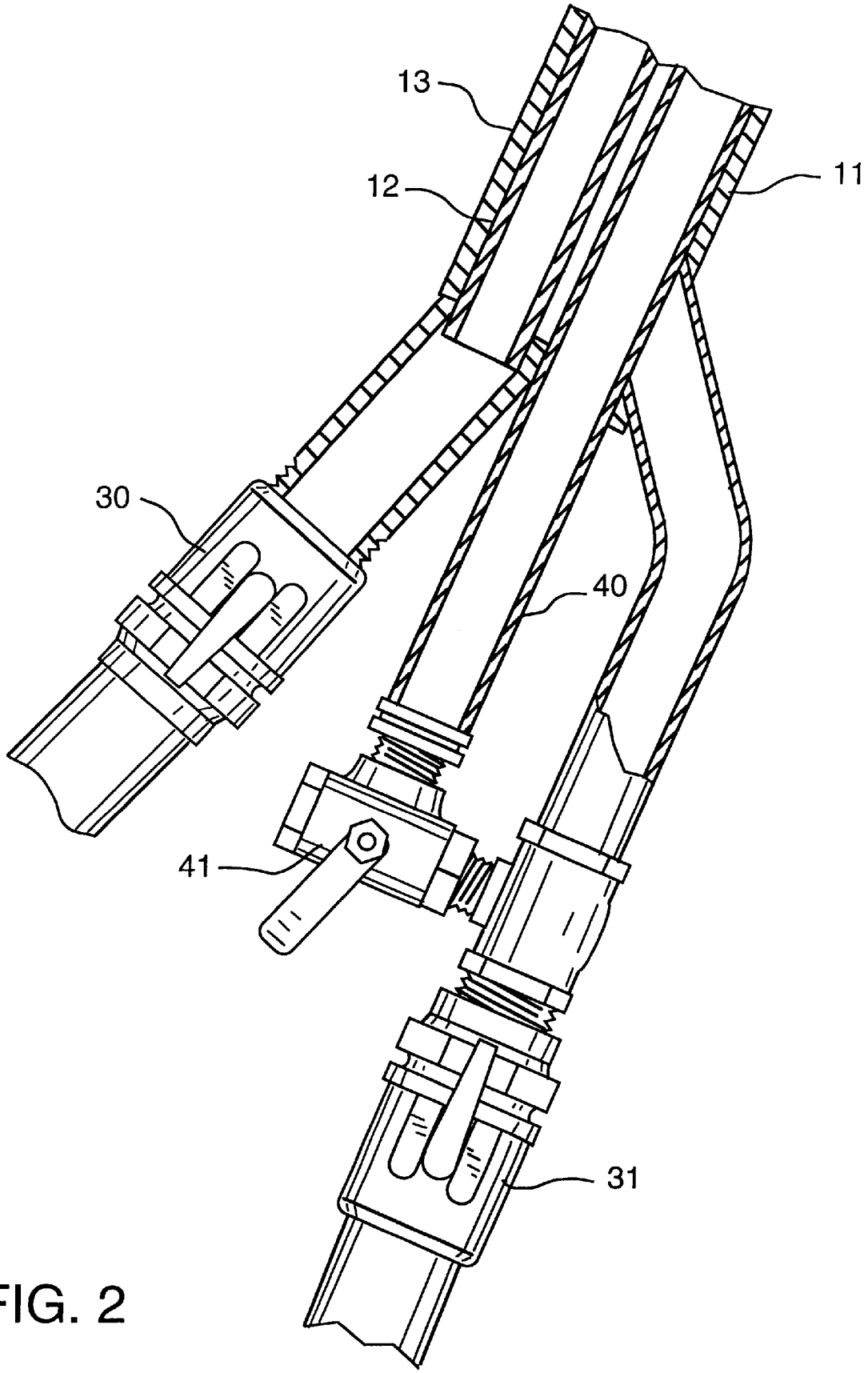
FIG. 2 is an enlarged view in vertical mid cross section of the lower end of the snow making tower illustrated in FIG. 1 as seen along section line II—II.
Figure 3:
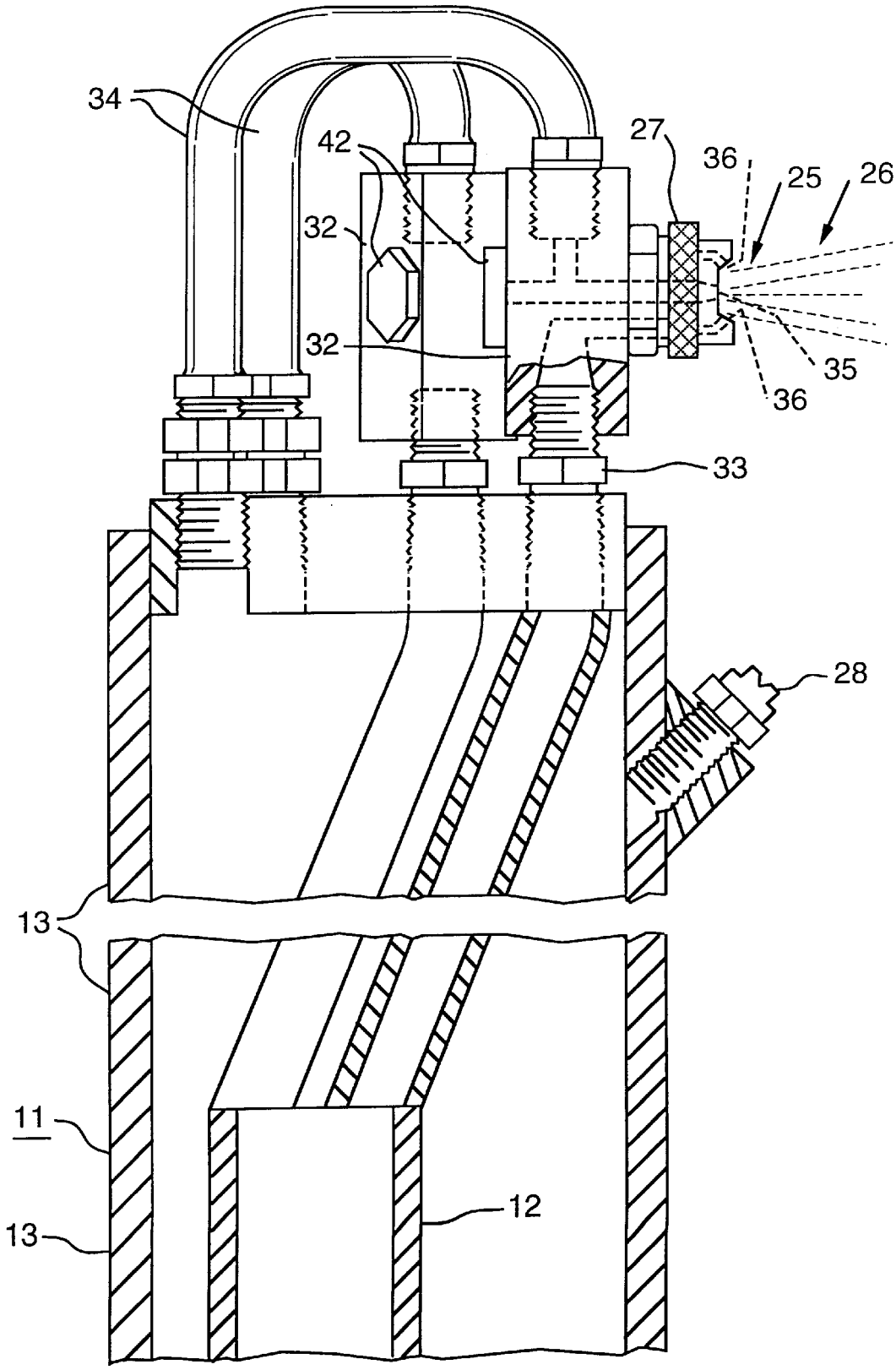
FIG. 3 is an enlarged view in vertical mid cross section of the upper end of the snow making tower illustrated in FIG. 1 as seen along section line III—III.
Figure 4:
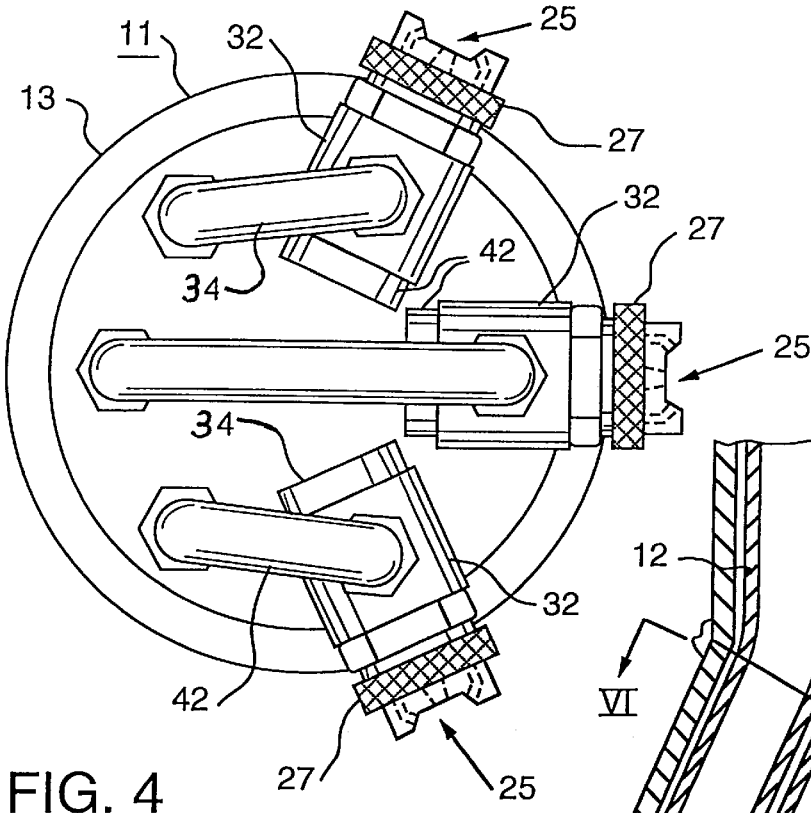
FIG. 4 is a top view of the nozzle structure illustrated in FIG. 3.

Referring to the drawings, the snow making tower 10 of the present invention is comprised of an elongated tower conduit combination 11 including an elongated air conduit 12 extending within an elongated first water conduit 13. This elongated tower conduit combination 11 is provided with a ground support mount 14 which includes a ground support pole 15 having its lower end anchored in ground surface 16 and a support pipe 17 of larger diameter coaxially mounted on the top of support pole 15 for axial rotation thereon. Support pipe 17 is mounted on top of support pole 15 by means of a bolt that passes through support pipe 17 and rests on top of pole 15.

Conduit combination 11 is in turn clamped to upwardly facing elongated U-channel 18 by means of spaced U-bolt clamps 19. Support channel 18 is in turn pivotally secured to the upper end of support pipe 17 by means of pivot pin 20 which permits the tower structure of elongated tower conduit combination 11 to be pivoted thereabout in a vertical plane for access to the nozzles at the top of the tower for maintenance, replacement or repair.

Elongated tower conduit combination 11 is held in the operating position illustrated in FIG. 1 by means of hold-down chain 21. The tower structure may be initially pulled down into this position by the chain hoist 22, which is also connected between the lower end of the tower conduit combination 11 and the lower end of support pipe 14.

Air and first water discharge nozzles 25 are provided adjacent the upper ends of the air and water conduits 12 and 13 for each producing a plume 26 of atomized or nucleated water created from external interacting air and water discharged under pressure from air and first water discharge nozzles 25 provided in the single nozzle head 27 to produce snow in subfreezing ambient conditions.

Nine second water discharge nozzles 28 are provided adjacent the upper end of the elongated first water conduit 13 and positioned for directing at least a portion of water spray discharged therefrom for interaction with the three plumes 26. Air coupling and water coupling 30 and 31 are respectively provided at the lower ends of the air and first water conduits 12 and 13 for respective connection to air and water supplies under pressure.

The combination air and first water discharge nozzle heads 27 are detachably mounted in respective nozzle housings 32 which are supported externally of all conduits at the top of the tower structure and connected respectively to upper ends of the air and water conduits 12 and 13 through respective air and water connecting tubes 33 and 34. As is illustrated, the exposed portion of air connecting tube 33 is minimal in length for preventing freezing of moisture which may be present in air passing through this metal tube 33.

Water connecting tubes 34 are also metal tubes, preferably copper or aluminum, so that maximum heat transfer is provided for precooling water passing therethrough and preventing freezing of water on the external portions of tubes 34.

Air and first water discharge nozzles 25 are incorporated into a single nozzle heads 27 with a central water discharge orifice 35 and two air discharge orifices 36 which are positioned on opposite sides of water discharge orifice 35 and directed at an angle of approximately 45° to discharge air under pressure into water discharged under pressure from water discharge orifice 35 to produce nucleated water plumes 26.

Figure 5:
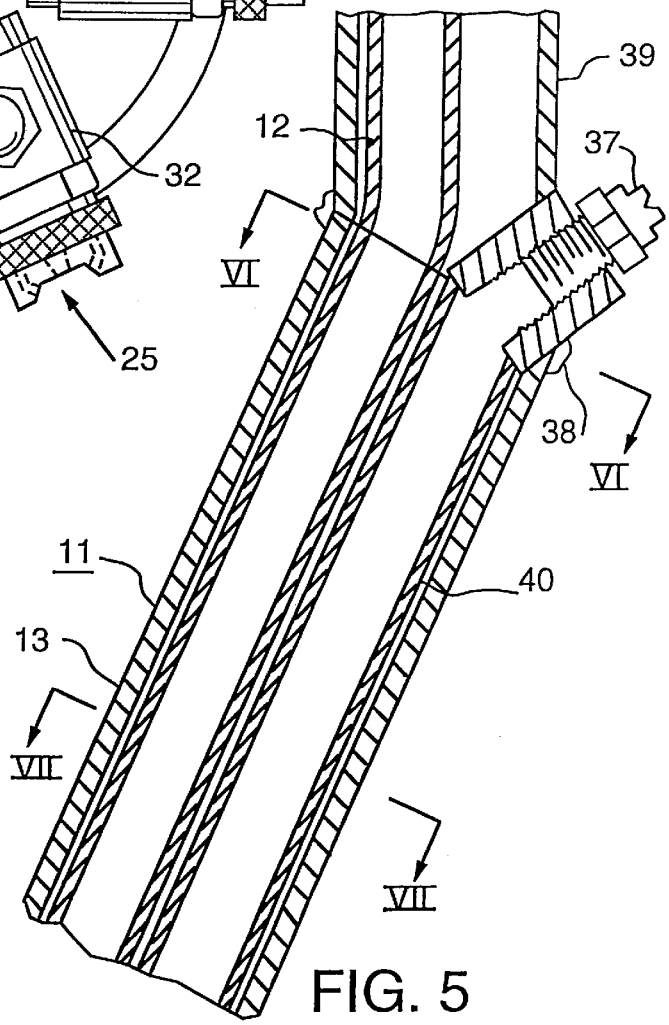
FIG. 5 is an enlarged view in vertical mid cross section with left hand portions removed illustrating the interior of the middle portion of the snow making tower shown in FIG. 1 as seen along section line V—V with all water nozzles removed.
Figure 6:
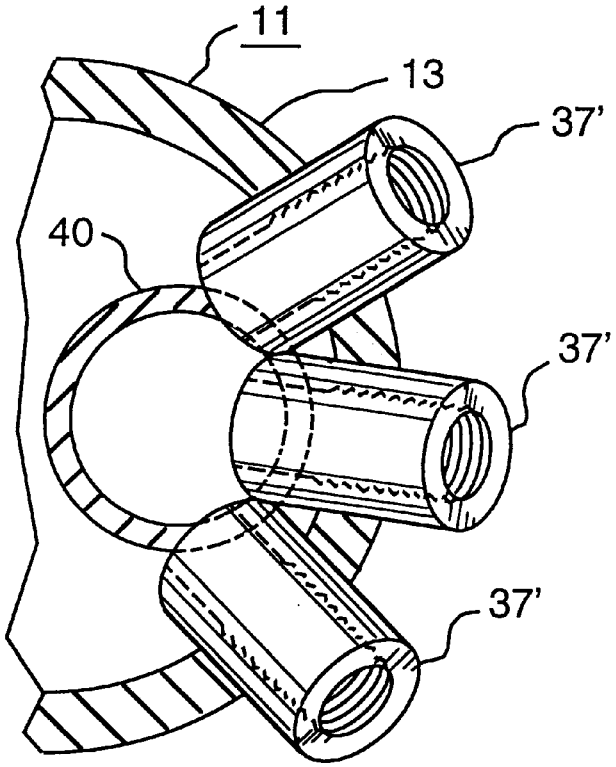
FIG. 6 is an enlarged view in horizontal cross section of the mid portion of the snow making tower shown in FIG. 5 as seen along section line VI—VI.
Figure 7:
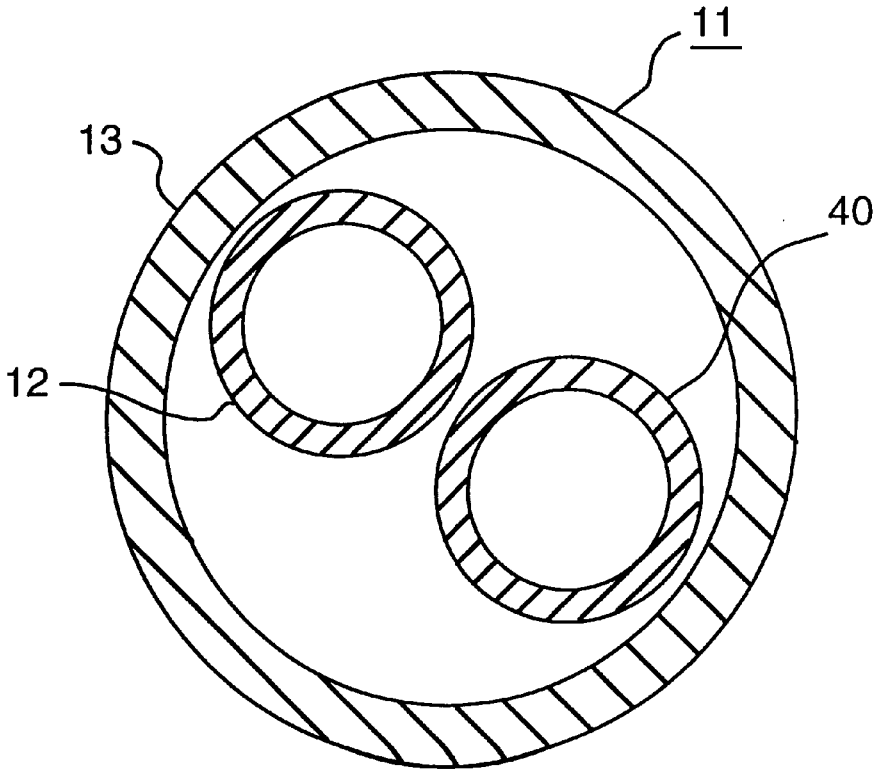
FIG. 7 is an enlarged view in horizontal cross section of the middle portion of the snow making tower illustrated in FIG. 5 as seen along section line VII—VII.

With particular reference to FIGS. 1, 5 and 6, three third water nozzles 37 are positioned on first water conduit 13 and threadably mounted in nozzle mounts 37' at the bend 38 in the conduit combination 11 where it bends from an angle of less than vertical to an angle of substantially vertical at its upper end 39 which supports the combination air and water nozzles 27 and second water nozzles 28.

Third water nozzles 37 are supplied by an independent water conduit 40 which also extends through the interior of water conduit 13 and exits at the bottom thereof through valve 41 to the same water supplied by coupling 31 for selectively connecting the lower end of third water conduit 40 to a supply of water under pressure.

Each of the metal nozzle housings 32 included a removable clean-out plug 42 positioned opposite the single nozzle heads 27 whereby internal access is provided to single nozzle heads 27 when plugs 42 are removed for permitting cleaning access to water discharge orifices 35.

The combination single nozzle heads 27 are items readily available on the market and are intended for use as paint spray nozzles. However, the present inventor has discovered that the use of these nozzles in the manner described herein provides a considerable savings of compressed air use and permits manufacture of snow at even higher ambient temperatures than heretofore thought possible. It is anticipated that as much as three fourths of the compressed air previously used may be saved with the apparatus of the present invention.

The air orifices 36 of single nozzle heads 27 are quite small in diameter and for example are typically 0.028 inches in diameter and water orifice 35 is typically 0.015 inch in diameter. It has been discovered that these nozzle heads 27 produce an extremely well nucleated plume 26 which therefore provides the afore-described advantages and permits excellent interaction with water sprays from additional water nozzles 28 and 37.

I claim:

1. A snow making tower comprising:

an elongated tower conduit combination including an elongated air conduit extending within an elongated first water conduit and having upper and lower ends and provided with a ground support mount;

air and first water discharge nozzles respectively provided adjacent the upper ends of said conduits for producing a plume of atomized water from external interacting air and water discharged under pressure from said air and first water discharge nozzles to produce snow in subfreezing ambient conditions;

at least one second water discharge nozzle adjacent the upper end of said elongated first water conduit and positioned for directing at least a portion of water spray discharged therefrom for interaction with said plume;

couplings for connecting air and water under pressure respectively to the lower ends of said air and first water conduits;

said air and first water discharge nozzles detachably mounted in a nozzle housing supported externally of said conduits and connected respectively to upper ends of said conduits with air and water connecting tubes.

2. The snow making tower of claim 1 wherein portions of the air connecting tube which are exteriorly exposed of said tower conduit combination are minimal in length for preventing freezing of moisture which may be present in air passing therethrough.

3. The snow making tower of claim 2 wherein said connecting tubes are metal tubes.

4. The snow making tower of claim 3 wherein said air and first water discharge nozzles are incorporated into a single nozzle head with a central water discharge orifice and two air discharge orifices positioned on opposite sides of said water discharge orifice and directed to discharge air under pressure into water discharged under pressure from said water discharge orifice.

5. The snow making tower of claim 4 including a third water nozzle positioned on said first water conduit for directing additional water spray into said plume.

6. The snow making tower of claim 5 including a third conduit independently supplying said third water nozzle with water under pressure, and a valve for selectively connecting a lower end of said third conduit to a supply of water under pressure.

7. The snow making tower of claim 6 wherein said elongated tower conduit combination extends upwardly at an angle from vertical and an upper portion thereof which supports said first and second water nozzles extends from a bend in said conduit combination in a more vertical manner, and said third water nozzle is positioned at said bend.

8. The snow making tower of claim 4, said nozzle housing including a removable clean-out plug positioned opposite said single nozzle head whereby internal access is provided to said single nozzle head when said plug is removed for permitting cleaning access to said water discharge orifice.

* * * * *